US011297425B2

(12) United States Patent
Nguyen et al.

(10) Patent No.: US 11,297,425 B2
(45) Date of Patent: Apr. 5, 2022

(54) INTERCOM SIGNAL MIXER HAVING CHANNEL TILES

(71) Applicant: Robert Bosch GmbH, Stuttgart (DE)

(72) Inventors: Quang Duy Nguyen, Bloomington, MN (US); Aleksandra Spiess, Rosemount, MN (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/851,635

(22) Filed: Apr. 17, 2020

(65) Prior Publication Data

US 2021/0329379 A1 Oct. 21, 2021

(51) Int. Cl.
*H04R 3/00* (2006.01)
*H04R 27/00* (2006.01)

(52) U.S. Cl.
CPC ..... *H04R 3/005* (2013.01); *H04R 27/00* (2013.01); *H04R 2420/01* (2013.01); *H04R 2420/09* (2013.01)

(58) Field of Classification Search
CPC .... H04R 3/005; H04R 27/00; H04R 2420/01; H04R 2420/09; H04R 2420/07; H04R 29/007; H04R 2227/003; H04R 2227/005; H04N 21/43615; H04B 3/548; H04B 3/58; H04B 2203/5445; H04B 2203/545; H04B 10/2589; H04B 10/2503; H04B 10/2575; H04B 10/25751; H04L 12/2838; H04M 11/025; G06F 3/0482; H04J 2203/001
See application file for complete search history.

(56) References Cited

U.S. PATENT DOCUMENTS

2010/0260247 A1* 10/2010 Albiston ..... H04B 3/548 375/222
2010/0316237 A1* 12/2010 Elberbaum ..... H04M 11/025 381/300
2017/0201850 A1* 7/2017 Raleigh ..... G06F 3/0482

* cited by examiner

*Primary Examiner* — Yogeshkumar Patel
(74) *Attorney, Agent, or Firm* — David M. Kovacek

(57) ABSTRACT

An intercom signal mixer having a number of channel controls associated with a respective number of channel tiles rendered by a display. The assignment for the channel controls may be adjusted by a user using the channel tiles, by selecting a new assignment from a list of available assignments presented in a continuously-scrolling carousel arrangement.

20 Claims, 4 Drawing Sheets

INTERCOM SIGNAL MIXER HAVING CHANNEL TILES

This disclosure relates to the routing and distribution of intercom signals in broadcast, theater, and studio production environments.

BACKGROUND

In broadcast, theater, and studio production environments, there is a need to provide intercom signals between members of the production staff, crew, and talent. Intercom systems may be electrically-enabled communications between distinct people and places working within one or more facilities. Intercom systems may additionally provide control and program material between various devices within the facility or outside of the facility. Contemporary intercom systems may-utilize a large number of devices supporting a larger number of users. In such systems, it may be desirable to selectively choose which other components of the intercom system are being actively monitored. It would be advantageous for an intercom system to permit a fast and intuitive method of selecting one or more other users of the intercom system for direct two-way communication and exchange of program or control data.

SUMMARY

One aspect of this disclosure is directed to an intercom signal mixer comprising a first input configured to receive first audio, a number of first busses operable to receive the first audio from the first input and deliver the first audio to one of a number of external devices, and a number of second inputs configured to receive second audio comprising channel audio from the number of external devices, a second bus operable to receive the second audio data. The second bus may be configured to output selected audio, the selected audio comprising a selective mix of the channel audio The intercom signal mixer may further comprise a number of channel controls, each associated with one of the number of second inputs, and a display operable to render information related to the channel controls, the rendered information comprising a number of channel tiles, each of the number of channel tiles corresponding to a respective subset of the number of channel controls. The channel tiles may be operable to display an assignment of the respective subset of the channel controls to a particular one of the number of second inputs, the assignment showing a selection of one of the number of second inputs accessible from a scrollable list of the number of second inputs displayed in a carousel arrangement, and wherein the respective subset of the channel controls are associated with the particular one of the number of second inputs.

Another aspect of this disclosure is directed to an intercom signal mixer comprising a first input configured to receive first audio, a number of first busses operable to receive the first audio from the first input and configured to deliver the first audio to a respective one of a number of external devices, a number of second inputs configured to receive second audio comprising channel audio from the number of external devices, each of the second inputs configured to receive the channel audio from the respective external device of the number of external devices. The intercom signal mixer may further comprise a second bus operable to receive the second audio data, the second bus configured to output selected audio, the selected audio comprising a selective mix of the channel audio. The intercom signal mixer may further comprise a program output operable to transmit program signals to at least one of the external devices and a program input operable to receive program signals from at least one of the external devices. The intercom signal mixer may further comprise a control output operable to transmit control signals to at least one of the external devices and a control input operable to receive control signals from at least one of the external devices. The intercom signal mixer may further comprise a number of channel controls, each of the channel controls associated with one of the number of second inputs. The intercom signal mixer may further comprise a display operable to render information related to the channel controls, the rendered information comprising a number of channel tiles, each of the number of channel tiles corresponding to a respective subset of the number of channel controls. Each of the channel tiles may be operable to display an assignment of the respective subset of the channel controls to a particular one of the number of second inputs, the assignment showing a selection of one of the number of second inputs accessible from a scrollable list of the number of second inputs displayed in a carousel arrangement, and wherein the respective subset of the channel controls are associated with the particular one of the number of second inputs.

The above aspects of this disclosure and other aspects will be explained in greater detail below with reference to the attached drawings.

BRIEF DESCRIPTION OF THE DRAWLS

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1A:
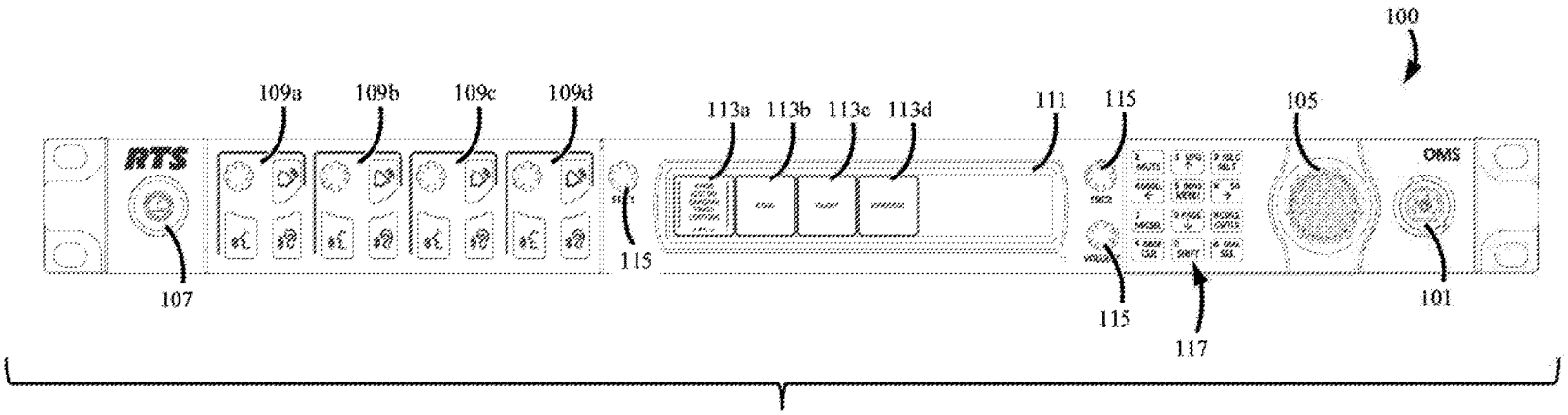
FIG. 1A is a front view of an intercom signal mixer.
Figure 1B:
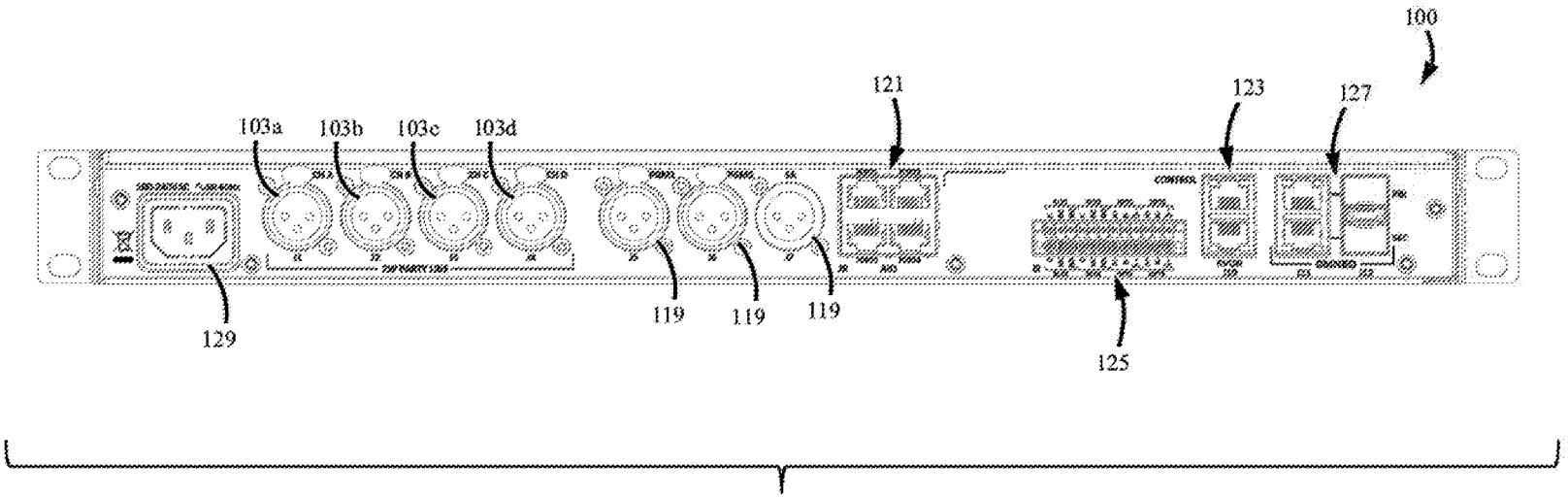
FIG. 1B is a rear view of an intercom signal mixer.

FIGS. 1A and 1B provide illustrations of the front face and rear face of an intercom signal mixer 100 respectively. Intercom signal mixer 100 may be configured to transmit an audio signal to a number of external devices, and receive return audio signal from the number of external devices. Once received, intercom signal mixer 100 may be operable to selectively present some of the audio signal returned from the number of external devices.

First audio may be provided to intercom signal mixer 100 via a first input 101. The depicted embodiment, first input 101 may comprise a multi-pin connector suitable for connection to a microphone device, but other embodiments may comprise other inputs suitable for receiving audio without deviating from the teachings disclosed herein. In some embodiments, first input 101 may comprise a built-in microphone element without deviating from the teachings disclosed herein. In some embodiments, first input 101 may comprise a connector suitable for receiving line-level audio signals, digital audio signals, or any other audio connection without deviating from the teachings disclosed herein. Some embodiments may comprise a plurality of first inputs 101 having the same or different configurations without deviating from the teachings disclosed herein.

Intercom signal mixer 100 may be in direct wired connection with a number of external devices, and may be operable to transmit first audio received by first input 101 via one or more first outputs. The first audio may be passed to a number of first busses in data communication with the first outputs, which in turn may be in data communication with the external devices. The external devices may transmit second audio back to intercom signal mixer 100, which may be received at second inputs. In some embodiments, first input 101 may comprise a connector that is compatible for both input and output of signal, such as a connector suitable for a headset having a microphone and speaker, without deviating from the teachings disclosed herein. In the depicted embodiment, both the first outputs and the second inputs may be encompassed by bi-directional input-output (I/O) 103, but other embodiments may comprise distinct connections for the first outputs and the second inputs without deviating from the teachings disclosed herein. In the depicted embodiment, bi-directional I/O 103 May comprise XLR connectors, but other embodiments may comprise other connectors without deviating from the teachings disclosed herein. In embodiments having distinct first outputs and second inputs, the first outputs and second inputs may comprise the same or different connectors without deviating from the teachings disclosed herein.

The second audio received by bi-directional I/O 103 may be presented via a second output 105 operable to present audio data to a user. In the depicted embodiment, second output 105 may comprise an internal speaker, but other embodiments may comprise other configurations, such as an electrical signal connection, without deviating from the teachings disclosed herein. In the depicted embodiment, intercom signal mixer 100 may further comprise a distinct second output in the form of a jack 107, which may be configured to provide an alternative second output, such as to a headphone device. In some embodiments, jack 107 may comprise a multi-pin configuration operable to additionally provide a headset connection having an input and an output function, and thus provide an alternative first input without deviating from the teachings disclosed herein. In some embodiments, jack 107 may provide the functionality of only an input or only an output without deviating from the teachings disclosed herein. Some embodiments may comprise a jack 107 that may provide an input, an output, or both an input and an output depending on the configuration of the connector inserted into the jack. In some embodiments, jack 107 may be programmable and may provide different functions in different contexts determined by other components of the system. In the depicted embodiments, each of the first input, first output, second input, and second output connections are provided by wired electrical connections, but other embodiments may comprise a wireless connection for some or all of these without deviating from the teachings disclosed herein.

Intercom signal mixer additionally comprises a number of channel controls 109, the channel controls 109 comprising a number of subsets thereof providing identical functionality. Each of the channel controls may be operable to interact with a subset of the second audio called "channel audio," the channel audio corresponding to the returning audio from a particular one or more of the external devices. In this way, each of the channel controls 109 provides a similar set of functions in manipulating the desired presentation of the channel audio. The manipulated channel audio may be selectively mixed or summed to generate selected audio. The selected audio may then be transmitted to a second bus in data communication with second output 105, where it is presented to the user.

Intercom signal mixer 100 further comprises a display 111 operable to provide a user visual information rendered thereupon. In the depicted embodiment, display 111 is shown to be operable to render a number of channel tiles 113, each of the channel tiles 113 operable to be assigned to a subset of the second audio comprising a particular channels of channel audio. The assignment of a channel tile 113 may correspond to a single external device or a plurality of external devices. When a channel tile 113 is assigned to a plurality of external devices, each of the respective external devices may be in communication with intercom signal mixer 100 and also with each other, sometimes referred to as a "party line" mode. In the depicted embodiment, each of channel tiles 113 may be configured to render a selection assignment, but other embodiments may comprise other functions of the channel tiles 113 without deviating from the teachings disclosed herein. User interaction with the rendered information of display 111 may be accomplished using a number of multi-function controllers 115 and number pad 117. In the depicted embodiment, multi-function controllers 115 may be configured as display controls operable to perform a variety of context-sensitive functions with respect to display 111. Multi-function controllers 115 may comprise click-wheel knobs having a push-button function, but other embodiments may comprise other configurations, without deviating from the teachings disclosed herein. In the depicted embodiment, number pad 117 may comprise a set of twelve push buttons having context-sensitive functions with respect to display 111, but other embodiments may comprise other configurations without deviating from the teachings disclosed herein. In some embodiments, additional physical controls may be utilized, such as a touch-screen, a switch, a context-sensitive soft key, a multi-axis control stick, jog wheel, or any other physical control known to one of ordinary skill in the art without deviating from the teachings disclosed herein. In some embodiments, external controllers may be operable to interact with display 111, such as external keypads, external keyboards, computer mouse, joystick, stylus input, haptic input, or any other external controller known to one of ordinary skill in the art without deviating from the teachings disclosed herein.

In the depicted embodiment, intercom signal mixer 100 may comprise a number of other connections that provide desired functions suitable for intercom use. Intercom signal mixer 100 may comprise a number of program. I/O 119 operable to exchange media data, such as pre-recorded audio or video data. Program I/O 119 may be operable to provide additional controls of an audio-visual component of a presentation in a broadcast, studio, or theater environment. In the depicted embodiment, intercom signal mixer may additionally comprise an RJ45 program I/O 121, comprised of a number of RJ45 connectors, which may advantageously permit transfer of media data utilizing RJ45-compatible protocols, such as Ethernet, RS-485 data, or other compatible protocols. In some embodiments, program I/O 119 may comprise a connector that is compatible with a fiber optic connection protocol without deviating from the teachings disclosed herein. Program I/O 119 and RJ45 program I/O 121 may be utilized to generate a network of media monitoring data between devices, which may advantageously permit a user to improve understanding of their functions with respect to the presentation in the working environment. In the depicted embodiment, program I/O 119 and RJ45 program I/O 121 may comprise bi-directional communication ports, but other embodiments may comprise distinct input ports and output ports without deviating from the teachings disclosed herein.

Intercom signal mixer 100 may further comprise a number of control I/O 123 and relay I/O 125, which may be connected to external devices to create a control network or matrix of devices working in tandem. Control I/O 123 may be utilized to Provide direct control of device functions from a remote unit, or to a remote unit at the intercom signal mixer 100. In some embodiments, control I/O 123 may comprise a connector that is compatible with a fiber optic connection protocol without deviating from the teachings disclosed herein. Relay I/O 125 may be utilized to provide a synchronous transmission of control or program data to a network of devices that includes the intercom signal mixer 100, or receive synchronous transmission of control or program data form an external device within the network. In some embodiments, relay I/O 125 may comprise a connector that is compatible with a fiber optic connection protocol without deviating from the teachings disclosed herein.

Intercom signal mixer 100 may further comprise a number of joint I/O 127, which may be connected to one or more external devices. Joint I/O 127 may comprise any combination of audio data, program data, control data, synchronization data, or any combination thereof. In the depicted embodiment, joint I/O 127 may comprise a number of RJ45 ports compatible with a joint transmission protocol, such as an OMNEO™ protocol. Other embodiments may comprise other configurations compatible with different connectors or different protocols without deviating from the teachings disclosed herein. In some embodiments, joint I/O 127 may comprise a connector that is compatible with a fiber optic connection protocol without deviating from the teachings disclosed herein.

Intercom signal mixer 100 may further comprise a power input 129, operable to provide electrical power to the unit. In the depicted embodiment, power input 129 may be comprised of a single IEC connection, but other embodiments may comprise additional inputs that advantageously provide redundancy in powering the components of intercom signal mixer 100 without deviating from the teachings disclosed herein. In some such embodiments, some of the power inputs may rely upon direct current (DC) power supplies and others may rely upon alternating current (AC) power supplies without deviating from the teachings disclosed herein.

Figure 2:
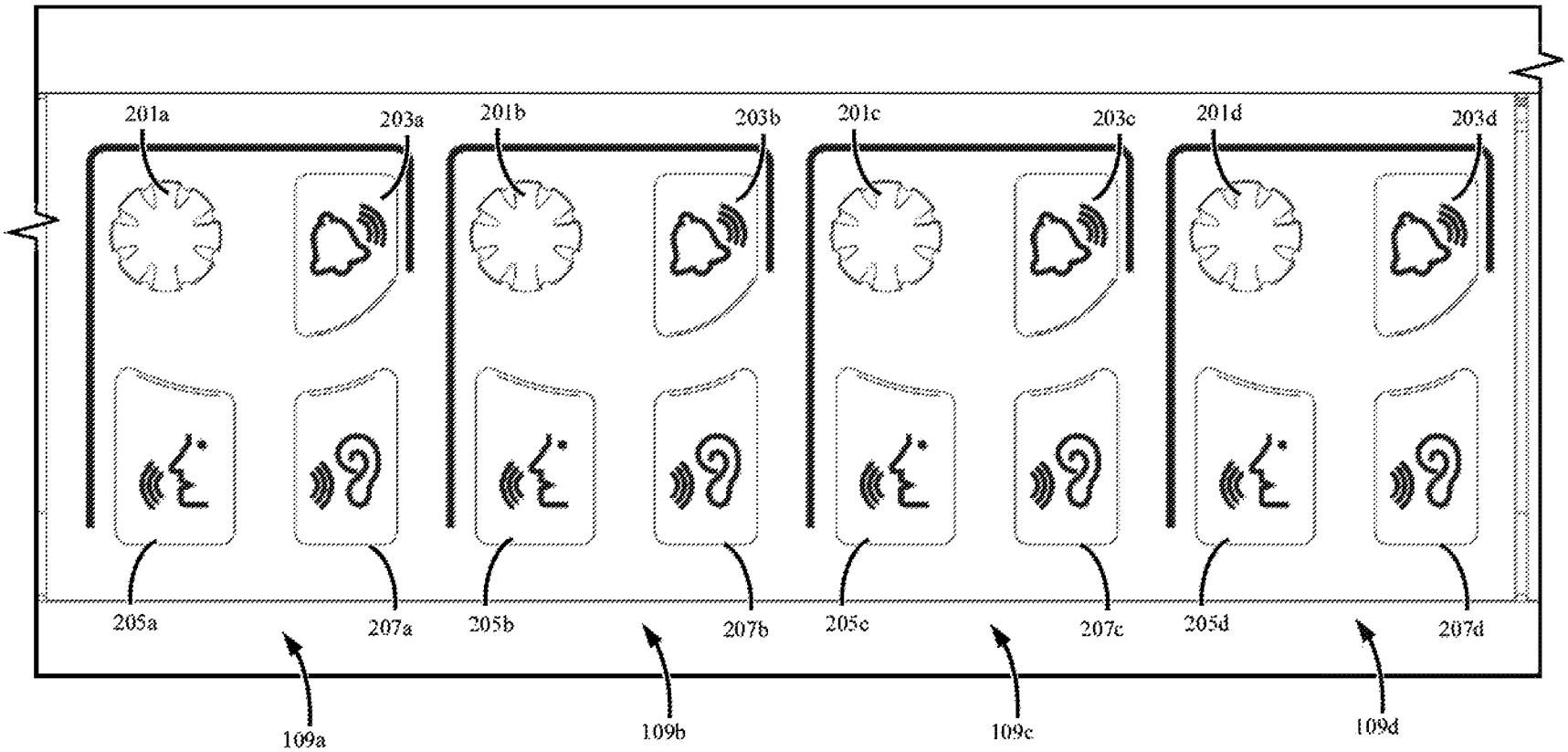
FIG. 2 is a close-up view of channel controls of an intercom signal mixer.

FIG. 2 is a close-up illustration of the channel controls 109 of intercom signal mixer 100 (see FIG. 1). Channel controls 109 comprise a number of subsets, channel controls 109*a*, 109*b*, 109*c*, and 109*d*. Each of the subsets of channel controls 109 may be directed to functions associated with channel audio from one or more of a number of external devices. In the depicted embodiment, each of the subsets of channel controls 109 have identical functions, but other embodiments may comprise other configurations without deviating from the teachings disclosed herein.

Each of the subsets of channel controls 109 may comprise a multi-function knob 201. In normal operation, knob 201 may default to a volume knob operable to control the relative volume of the associated channel audio in the selected audio presented by the second output bus. However, knob 201 may be context-sensitive, based upon the operating status of intercom signal mixer 100 and the status of display 111 (see FIG. 1). In some embodiments, knob 109 may be pressed to enter an assignment epode for the associated subset of the channel controls 109. For example, pressing the button of knob 201*a* may permit a user to assign the functional controls 109*a* to a particular channel of the channel audio. Other embodiments may comprise other functions within other contexts without deviating from the teachings disclosed herein.

Each of the subsets of channel controls 109 may comprise a call button 203. Call buttons 203 may be operable to engage transmission of a predetermined call signal to the external device associated with the respective channel control subset. For example, pressing call button 203*a* may transmit a call signal to the external device currently associated with channel controls 109*a*. In some embodiments, different channel control subsets may comprise distinct call signals without deviating from the teachings disclosed herein. Call signals may be generated using an onboard oscillator, a wave table, an algorithmic generation code, or any other signal-generator known to one of ordinary skill in the art at the time the invention was, made. In some embodiments, call buttons 203 may illuminate or flash when intercom signal mixer 100 receives a call signal from one of the external devices. In such embodiments, the call button 203 associated with the particular channel of the respective external device may illuminate when the call signal is received. Illumination may end based upon a timer, or in response to a user pressing the associated call button 203. Other embodiments comprise other configurations without deviating from the teachings disclosed herein.

Each of the subsets of channel controls 109 may comprise a talk button 205. Talk button 205 may selectively enable transmission of audio data from the first input to the external device currently associated with the respective channel control subset. For example, pressing talk button 205*a* may selectively enable transmission of first audio from the user of intercom signal mixer 100 to the external device currently associated with channel controls 109*a*. In some embodiments, talk button 205*a* may comprise a latching button. A latching button configuration may advantageously permit a user of intercom signal mixer 100 to speak without requiring continued use of the user's hands. Other embodiments may comprise a momentary switch which toggles the transmission state of the first audio without deviating from the teachings disclosed herein. In some embodiments, talk button 205 may illuminate when transmission is active to advantageously provide a visual indication of Which external devices are receiving the user's first audio. Other embodiments may comprise other configurations without deviating from the teachings disclosed herein.

Each of the subsets of channel controls 109 may comprise a listen button 207. Listen button 207 may selectively enable inclusion of channel audio from the external device currently associated with the respective channel control subset in the selected audio presented to the user via a second output. For example, pressing listen button 207*a* may selectively output channel audio received from the external device currently associated with channel controls 109*a* within the selected audio presented to the user via a second output of intercom signal mixer 100. In some embodiments, listen button 207 may comprise a latching button. A latching button configuration may advantageously permit the user of intercom signal mixer 100 to include the channel audio of the respective associated external devices without requiring continued use of the user's hands. Other embodiments may comprise a momentary switch which toggles the inclusion of the associated channel audio in the selected audio without deviating from the teachings disclosed herein. In some embodiments, listen button 207 may illuminate when transmission is active to advantageously provide a visual indication of which external devices are being included in the selected audio presented to the user via a second output. Other embodiments may comprise other configurations without deviating from the teachings disclosed herein.

Figure 3:
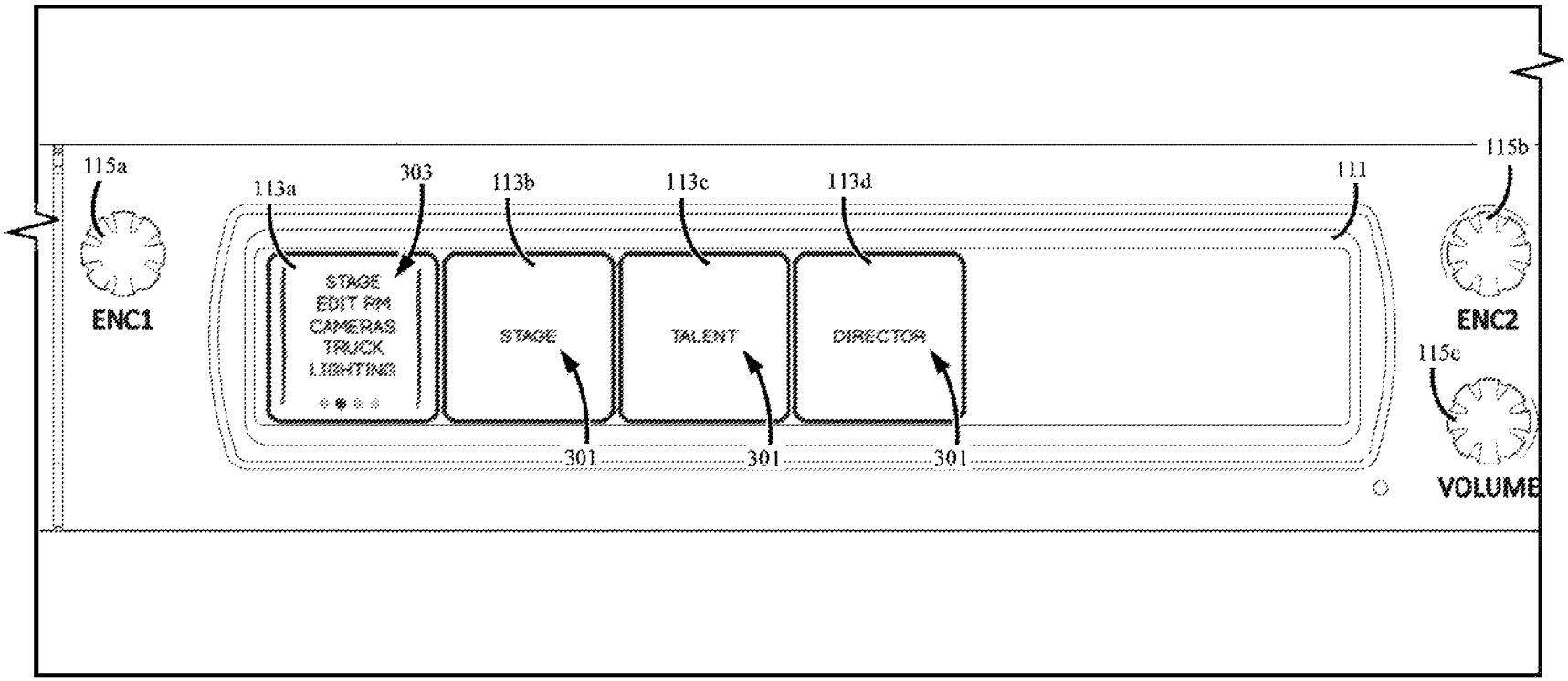
FIG. 3 is a close-up view of a display of an intercom signal mixer having a set of channel tiles.

Because the operation of channel controls 109 is dependent upon an assignment of channel audio to each of the subsets of the channel controls, it is desirable to provide a user a simple and intuitive way of making assignments for channel controls 109. FIG. 3 presents a close up view of display 111 (see FIG. 1), rendering channel tiles 113 which may show a current assignment of each subset of channel controls 109. In the depicted embodiment, channel tiles 113 are ordered to correspond to the same order of channel controls 109 (see FIG. 2). Thus, channel tile 113*a* corresponds to channel controls 109*a*, channel tile 113*b* corresponds to channel controls 109*b*, and so on. In the depicted embodiment, there are 4 subsets of channel controls 109, and thus there are four distinct channel tiles 113 displayed, but other embodiments may comprise other configurations without deviating from the teachings disclosed herein. In some embodiments, channel tiles 113 may be color-coordinated with their respective subset of channel controls 109 in order to advantageously assist a user in identifying which subset of the channel audio each subset of channel controls 109 correspond to.

It is desirable for a user to quickly and intuitively make adjustments to the channel assignments associated with each set of channel controls 109. In the depicted embodiment channel tiles 113*b*, 113*c* and 113*d* are shown actively displaying a channel assignment, while channel tile 113*a* is engaged in an assignment selection mode. When in an assignment selection mode, a list of all available external devices providing channel audio are listed, and the user may scroll through the list to make a selection. The list may be presented in a carousel configuration, wherein all of the assignable channels are presented in a continuously-scrolling loop, so that a user may choose to cycle through all options to find the desired assignment. In the depicted embodiment, the assignment selection mode of a channel tile 113 may be engaged by pressing the button of the associated knob 201 (see FIG. 2), and the list may be navigated by rotating the knob 201. Once the assignment selection mode is engaged, the associated channel tile 113 may remain in the assignment selection mode until a selection is made In some embodiments, the assignment selection mode may be cancelled after a predefined window of time without a selection or user input without deviating from the teachings disclosed herein. In the depicted embodiment, an arbitrary number of channel tiles 113 may be simultaneously engaged in the assignment selection mode concurrently, sometimes referred to as "slot-machine mode" because the channel tiles 113 resemble the scrolling behavior of a slot machine during the assignment selection mode. In some embodiments, the list of available assignments may dynamically adjust such that no channel may be assigned to the same external device as any other channel's current active assignment. In such embodiments, the lists displayed in assignment selection mode may be dynamically updated if other channel tiles 113 are assigned. For example, if channel tile 113*a* and 113*b* are both in assignment selection mode, their respective displayed lists may be identical until one of the channel tiles has been assigned, at which time the active assignment of that channel tile may be removed from the list in the other channel tile. Other embodiments may comprise arbitrary assignments without deviating from the teachings disclosed herein. In some embodiments, the list may comprise a NULL or "no assignment" selection that may be selected to associate none of the channel audio with the channel tile.

In order to improve the user-friendliness of intercom signal mixer 100, the names of channel assignments may be configured with a user-selectable alias. The user-selectable alias may permit a user to dynamically adjust the titling of channel audio into intuitive naming schema, thus improving the understanding of the interface. In the depicted embodiment, intercom signal mixer 100 may utilize default or suggested aliases, such as "STAGE," "EDIT RM," "CAMERAS", etc. But the user may enter an alias mode using multi-function controllers 115 or number pad 117. When in the alias mode, the user may provide custom aliases for each set of first outputs and second inputs that comprises an assignment. Aliases may be entered using multi-function controllers 115 or number pad 117. Other embodiments may comprise other functions and interfaces rendered by display 111 without deviating from the teachings disclosed herein.

The channel assignments may advantageously be made to a group of external devices. When such an assignment is made, intercom signal mixer 100 may be said to be operating in a "party line" mode. When operating in a party line mode, intercom signal mixer 100 may be in communication with each of the group of external devices via a single channel tile 113 and associated channel controls 109 (see FIG. 2). When operating in a party line mode, each of the group of external devices may be in communication with each other. By way of example, and not limitation, a number of the listed assignments presented in channel tile 113*a* may correspond to a party line mode assignment. For example, "STAGE" may assign the associated channel controls 109*a* to a subset of devices associated with workers on a stage of a studio or theater. Stage workers may be dispersed physically around the stage and unable to utilize a single external device between them, and thus a party line mode operation may be advantageously employed to coordinate the workers simultaneously.

Figure 4:
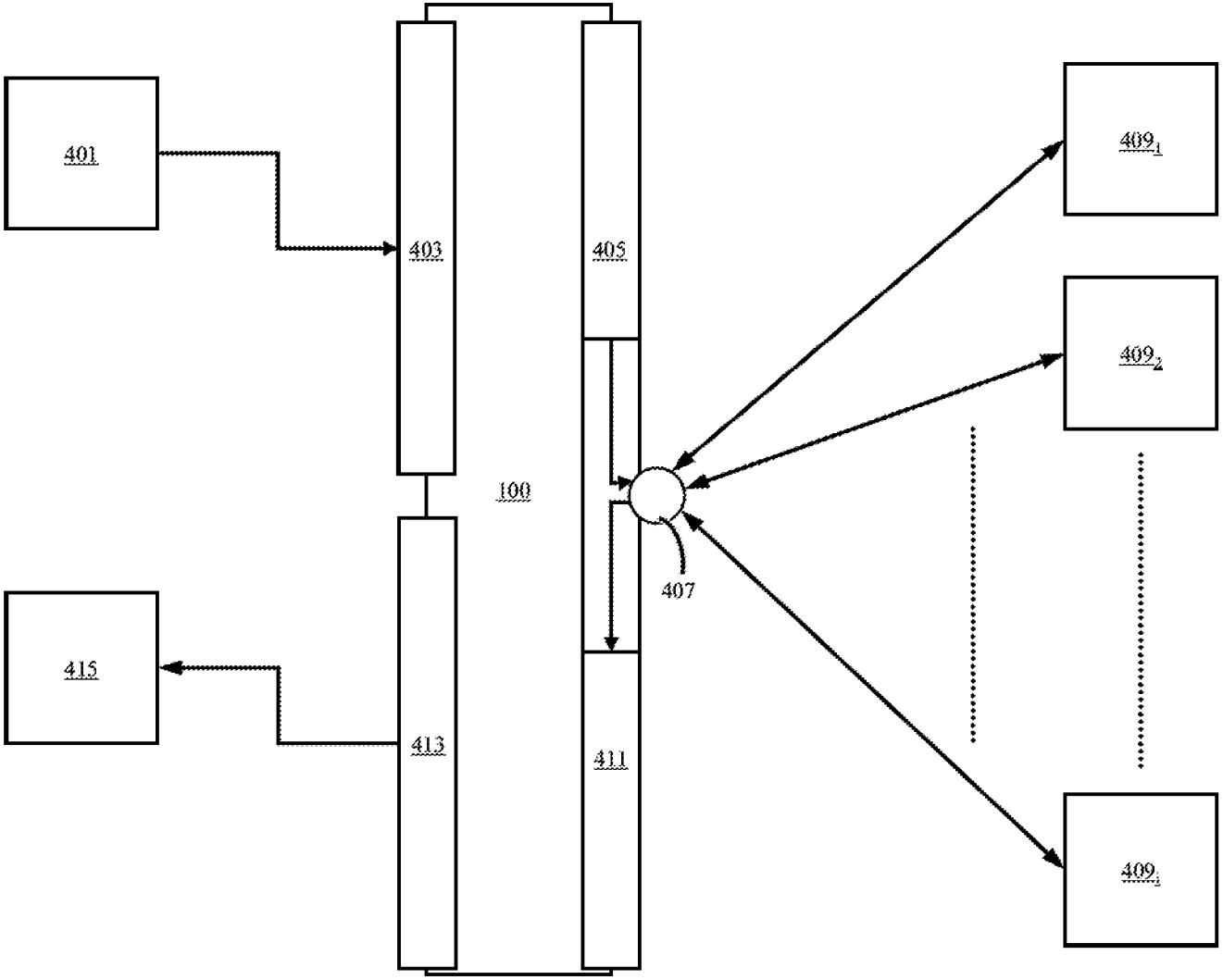
FIG. 4 is a diagrammatic view of an intercom signal mixer during operation.

FIG. 4 provides a diagrammatic view of intercom signal mixer 100 utilized in a system. Intercom signal mixer 100 may be fed first audio signal from an input device 401. Input device 401 may comprise a microphone, or other device configured to provide an audio signal. Input device 401 transmits the first audio to first input 403 of intercom signal mixer. The first audio and other signals may be transmitted from intercom signal mixer 100 via a first bus 405 that is in data communication with an I/O port 407. I/O port 407 may comprise a bi-directional I/O port operable to exchange data with a number of external devices 409. In the depicted embodiment, I/O port 407 may comprise a bi-directional communication port, but other embodiments may comprise distinct input ports and output ports without deviating from the teachings disclosed herein. Intercom signal mixer 100 may be in connection with an arbitrary number of external devices 409 via. I/O port 407. In some embodiments, intercom signal mixer 100 may be subject to a maximum limit of external devices 409 via a single I/O port without deviating from the teachings disclosed herein. For the purposes of illustration, and not limitation, the external devices presented herein are shown as an arbitray set, and given numeral designations from $\mathbf{409}_1$ to the arbitrary upper limit of $\mathbf{409}_i$. In the depicted embodiment, i is an integer greater than 2, but in practice i can be any positive integer without deviating from the teachings disclosed herein. In some embodiments, the connections may be dynamically implemented, such that the value of i changes as external devices 409 are added or removed from the network of connections to I/O port 407.

In the depicted embodiment, each of external devices 409 may transmit second audio or other data back to I/O port 407, which is received by intercom signal mixer 100 via second input 411. The second audio may comprise a set of channel audio, each channel in the channel audio comprising audio exchanged with a respective one of the external devices 409. Second audio received by intercom signal mixer 100 may be selectively presented to a user via a second bus 413, which is in communication with an output device 415, such as a speaker or headphone.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. An intercom signal mixer comprising:

a first input configured to receive first audio data;

a number of first busses operable to receive the first audio data from the first input, each of the number of first busses configured to deliver the first audio data to a respective one of a number of external devices;

a number of second inputs configured to receive second audio data comprising channel audio from the number of external devices, each of the second inputs configured to receive the channel audio from the respective external device of the number of external devices;

a second bus operable to receive the second audio data, the second bus configured to output selected audio, the selected audio comprising a selective mix of the channel audio;

a number of channel controls, each of the channel controls associated with one of the number of second inputs; and a display operable to render information related to the channel controls, the rendered information comprising a number of channel tiles, each of the number of channel tiles corresponding to a respective subset of the number of channel controls, where each of the channel tiles are operable to display an assignment of the respective subset of the channel controls to a particular one of the number of second inputs, the assignment showing a selection of one of the number of second inputs accessible from a continuously-scrollable list of the number of second inputs displayed in a carousel arrangement, wherein the continuously-scrollable list is dynamically adjusted based on the active assignments of the channel tiles, and wherein the respective subset of the channel controls are associated with the particular one of the number of second inputs.

2. The intercom signal mixer of claim 1, wherein the channel tiles are rendered in an order, each of the ordered channel tiles corresponding to an associated subset of the number of channel controls.

3. The intercom signal mixer of claim 1, wherein each of the number of second busses is associated with an alias, the alias being configurable by a user and rendered in the display when the respective second bus is assigned to the channel tile.

4. The intercom signal mixer of claim 1, further comprising display controls operable to permit a user to interact with the rendered information of the display.

5. The intercom signal mixer of claim 4, wherein the display controls comprise a number of multi-function controllers.

6. The intercom signal mixer of claim 1, wherein the channel tiles comprise 4 subsets of the channel controls.

7. The intercom signal mixer of claim 1, wherein each respective subset of the number of channel controls comprises a listen button operable to selectively mute the respective channel audio from the selected audio when engaged.

8. The intercom signal mixer of claim 1, wherein each respective subset of the number of channel controls comprises a volume knob operable to control the relative amplitude of the respective channel audio within the selected audio.

9. The intercom signal mixer of claim 1, wherein each respective subset of the umber of channel controls comprises a talk button operable to engage transmission of first audio to a respective external device associated with the respective second input via an associated one of the first busses.

10. The intercom signal mixer of claim 9, wherein each respective subset of the lumber of channel controls comprises a call button, operable to engage transmission of a predetermined call signal to a respective external device associated with the respective second input via the associated one of the first busses.

11. The intercom signal mixer of claim 1, further comprising a program input and program output, the program input configured to receive program signals from at least one of the external devices and the program output configured to transmit program signals to at least one of the external devices.

12. The intercom signal mixer of claim 11, wherein the program input and program output are each in data communication with a bi-directional communication port.

13. The intercom signal mixer of claim 1, further comprising a control input and a control output, the control input configured to receive a control signal from at least one of the external devices and the control output configured to transmit a control to at least one of the external devices.

14. The intercom signal mixer of claim 13, wherein the control input and the control output are each in data communication with a bi-directional communication port.

15. An intercom signal mixer comprising:

a first input configured to receive first audio data;

a number of first busses operable to receive the first audio data from the first input, each of the number of first busses configured to deliver the first audio data to a respective one of a number of external devices;

a number of second inputs configured to receive second audio data comprising channel audio from the number of external devices, each of the second inputs configured to receive the channel audio from the respective external device of the number of external devices;

a second bus operable to receive the second audio data, the second bus configured to output selected audio, the selected audio comprising a selective mix of the channel audio;

a program output operable to transmit program signals to at least one of the external devices;

a program input operable to receive program signals from at least one of the external devices;

a control output operable to transmit control signals to at least one of the external devices;

a control input operable to receive control signals from at least one of the external devices;

a number of channel controls, each of the channel controls associated with one of the number of second inputs; and a display operable to render information related to the channel controls, the rendered information comprising a number of channel tiles, each of the number of channel tiles corresponding to a respective subset of the number of channel controls, wherein each of the channel tiles are operable to display an assignment of the respective subset of the channel controls to a particular one of the number of second inputs, the assignment showing a selection of one of the number of second inputs accessible from a continuously-scrollable list of the number of second inputs displayed in a carousel arrangement, wherein the continuously-scrollable list is dynamically adjusted based on the active assignments of the channel tiles, and wherein the respective subset of the channel controls are associated with the particular one of the number of second inputs.

16. The intercom signal mixer of claim 15, wherein the control output and the control input are encapsulated in a bi-directional RJ45 port.

17. The intercom signal mixer of claim 15, wherein the program output and the program input are encapsulated in a bi-directional RJ45 port.

18. The intercom signal mixer of claim 15, wherein each of the number of first outputs is associated with a respective one of the number of second inputs, and wherein each association comprises a first output and second input and is encapsulated in a bi-directional XLR connector.

19. The intercom signal mixer of claim 15, wherein the control output and the control input are encapsulated in a bi-directional fiber optic port.

20. The intercom signal mixer of claim 15, wherein the program output and the program input are encapsulated in a bi-directional fiber optic port.

* * * * *